US005319329A

United States Patent [19]

Shiau et al.

[11] Patent Number: 5,319,329

[45] Date of Patent: Jun. 7, 1994

[54] MINIATURE, HIGH PERFORMANCE MMIC COMPATIBLE FILTER

[75] Inventors: Ming-Jong Shiau, Cerritos; Michael Vieru, Canoga Park; John C. Tippet, Rancho Palos Verdes, all of Calif.

[73] Assignee: TRW Inc., Redondo Beach, Calif.

[21] Appl. No.: 933,289

[22] Filed: Aug. 21, 1992

[51] Int. Cl.[5] ..... H01P 1/203; H01P 3/08

[52] U.S. Cl. ..... 333/204; 333/238; 333/246

[58] Field of Search ..... 333/202-205, 333/238, 246

[56] References Cited

U.S. PATENT DOCUMENTS

| | | | |
|---|---|---|---|
| 3,451,015 | 6/1969 | Heath | 333/204 X |
| 3,863,181 | 1/1975 | Glance et al. | 333/246 X |
| 3,904,997 | 9/1975 | Stinehelfer, Sr. | 333/238 X |
| 4,052,683 | 10/1977 | Van Heuven et al. | 333/238 X |
| 4,233,579 | 11/1980 | Carlson et al. | 333/204 |
| 4,849,722 | 7/1989 | Cruchon et al. | 333/246 X |
| 4,873,501 | 10/1989 | Hislop | 333/204 |
| 5,157,364 | 10/1992 | Pond et al. | 333/204 X |
| 5,192,927 | 3/1993 | Lin | 333/204 |

*Primary Examiner*—Seungsook Ham
*Attorney, Agent, or Firm*—Ronald L. Taylor

[57] ABSTRACT

A small, high performance MMIC compatible filter having a suspended dielectric substrate transmission medium to achieve superior Q. The substrate is suspended within an opening formed in a surrounding housing and has a plurality of conductive paths disposed thereon. An elliptical function response provides optimum filter size and insertion loss for a given required out-of-band rejection by making use of finite transmission zeroes on each side of the passband.

3 Claims, 2 Drawing Sheets

MINIATURE, HIGH PERFORMANCE MMIC COMPATIBLE FILTER

BACKGROUND OF INVENTION

1. Field of the Invention

This invention relates generally to monolithic microwave/millimeter wave integrated circuits (MMICs) and, more particularly, to a MMIC compatible bandpass filter.

2. Discussion

Various applications of monolithic microwave/millimeter wave integrated circuits, or MMIC devices, require integration with a bandpass filter which passes on signal components in a specified frequency band (the pass band) while substantially attenuating signal components not in the pass band. These out-of-band signals are rejected and are not passed on to other circuit elements. To be effective, such a filter must pass on inband signal components with an absolute minimum amount of loss and, at the same time, must be small enough in size to be suitable for integration with MMIC devices on the same chip.

Currently available MMIC compatible filters are usually based on either lumped constant (LE) circuits, in which circuit elements include chip capacitors and spiral inductors, or parallel coupled line (PCL) geometries wherein half-wavelength circuit elements (resonators) are utilized. For example, FIG. 1 shows a typical conventional (PCL) microwave filter 10 having parallel coupled line geometry. Filter 10 includes a dielectric substrate 12 having on a top surface thereof a printed microstrip circuit element 14 consisting of a series of parallel conductive paths which individually form half-wavelength resonators. The substrate 12 further includes, on the surface thereof opposite circuit 14, a solid printed circuit layer 16 which completely covers that surface of substrate 12 and which is positioned against and electrically coupled to a conductive ground plane 18.

Ground plane 18 is generally U-shaped in cross section for receiving the Gallium Arsenide (GaAs) substrate 12 fitting therein. As the millimeter or microwaves pass through the filter they are substantially confined between printed circuit element 14 and ground plane 18. Passband waves enter the input port 13, are coupled through resonators 14 and then exit through output port 15. The out-of-band signal components are attenuated or rejected.

Both PCL and LE types of filters, however, exhibit high passband loss due to the low unloaded Q (15–25) achievable with thin substrate microstrip and miniature lumped constant circuit elements. The PCL type of filters are generally limited to bandwidths of up to 30 percent and their rejection characteristics are adversely affected by the dispersive nature of the inhomogeneous microstrip medium as well as by circuit related factors such as tight couplings. The LE type of filters have poor high frequency rejection due to component self-resonances and require a multilayer deposition process which adds to the overall cost of the device. The LE type of MMIC filters are even lossier than their conventional PCL type counterparts due to the very low Q of spiral inductors.

There is, therefore, a need for a MMIC compatible bandpass filter which is virtually loss free and which can be easily integrated with MMIC devices. It is desirable that such a filter be small and low cost and have a low loss passband of up to an octave (e.g., 8 to 15 GHz).

SUMMARY OF THE INVENTION

The present invention provides an improved MMIC compatible filter by suspending a dielectric substrate within an opening formed in a surrounding housing. A plurality of conductive paths disposed on the substrate form an electrical filter. This arrangement achieves superior Q and employs less than one-eighth wavelength circuit elements to minimize filter size. An elliptical function response in the preferred embodiment provides optimum filter size and minimum insertion loss for a given required out-of-band rejection by making use of finite transmission zeroes on each side of the passband.

Additional features and advantages of the present invention will become apparent to those skilled in the art upon reading the following detailed description and referring to the accompanying drawings.

DETAILED DESCRIPTION OF THE PREFERRED EMBODIMENT

Figure 1:
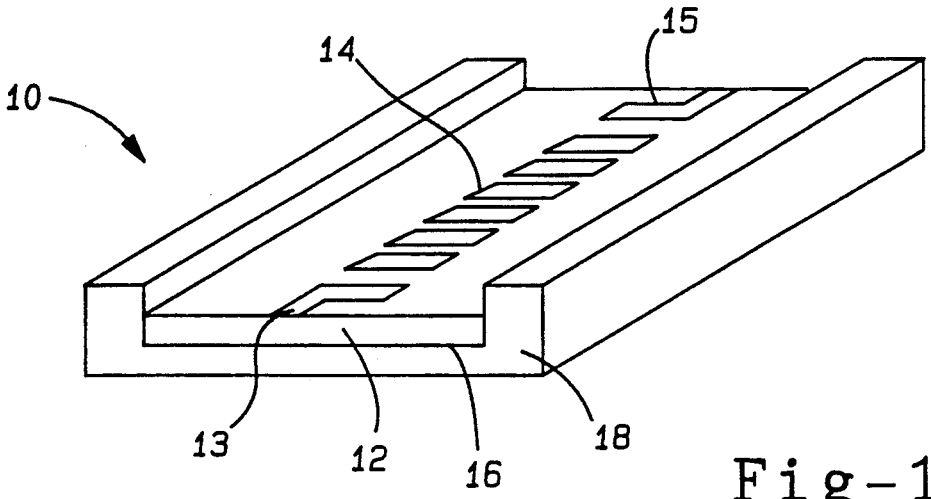
Fig-1 PRIOR ART
FIG. 1 is a perspective view of a typical conventional MMIC compatible filter based on a parallel coupled line geometry.
Figure 2:
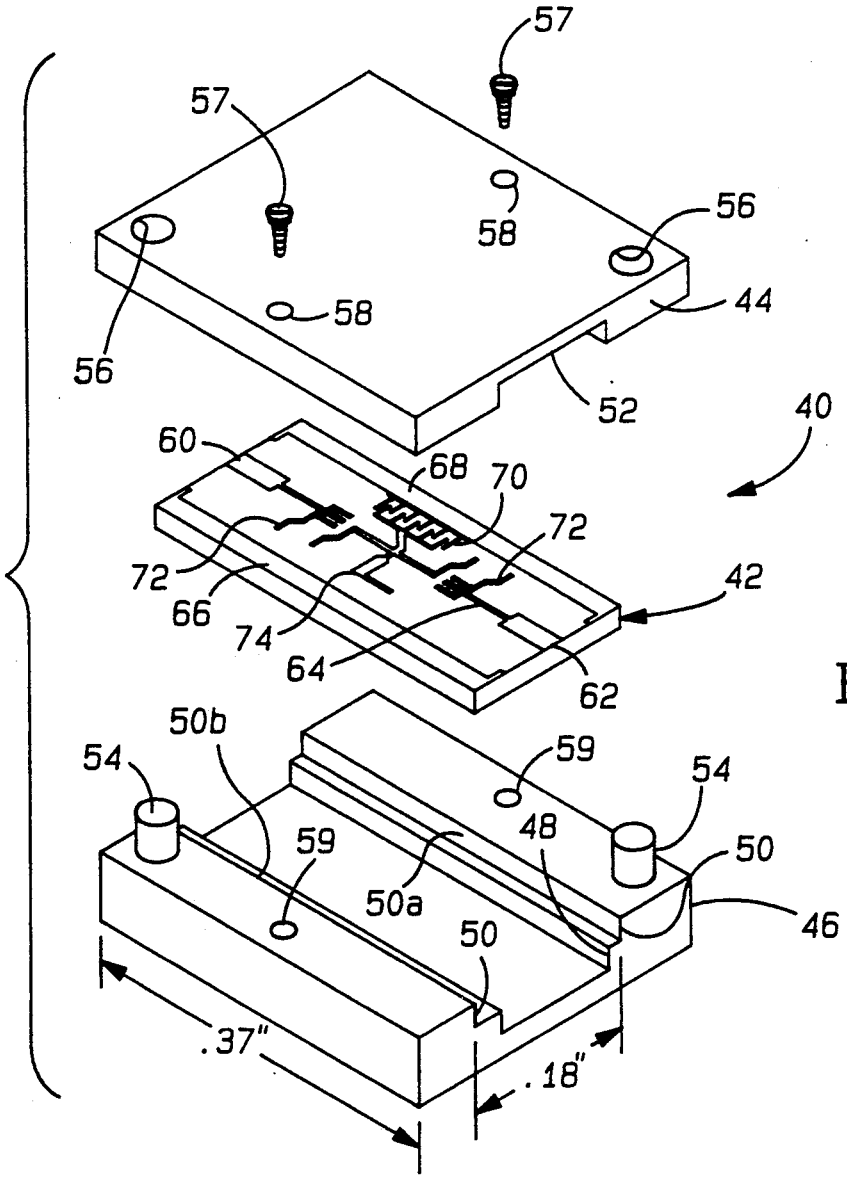
FIG. 2 is an exploded perspective view of the MMIC compatible bandpass filter of the present invention.
Figure 3:
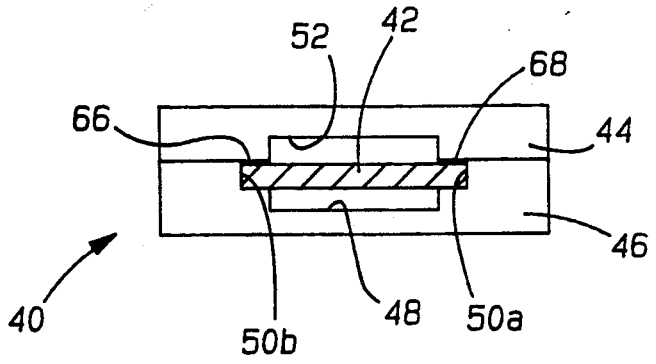
FIG. 3 is a side view of the assembled filter of the present invention.

Referring now to the drawings, the bandpass filter of the present invention is indicated generally at 40 in FIG. 2. Filter 40 includes a dielectric substrate 42, preferably a Gallium Arsenide (GaAs) sheet about 4 mils thick having a length of approximately 0.37 inches and a width of about 0.18 inches. When filter 40 is assembled as shown in FIG. 3, substrate 42 is sandwiched between a top cover 44 and a bottom base 46. Top cover 44 and base 46 are preferably made from a conductive metallic material such as aluminum or copper and cooperate to form an enclosing housing as well as a ground plane for substrate 42.

Base 46 is preferably generally rectangular in shape and less than an inch across. Base 46 is preferably substantially U-shaped in cross section, having a rectangular channel 48 running through the center of a top surface thereof as well as a stepped shoulder region 50 which is parallel to, adjacent and outboard of each side of channel 48. The distance between surfaces **50*a* and 50*b* of stepped shoulder region 50 is preferably equal to the width of substrate 42 with channel 48 being slightly smaller in width in order to retain substrate 42 within stepped region 50 and suspend substrate 42 over channel 48 as shown in FIG. 3**.

Top cover 44 also has a rectangular channel 52 formed therein which is parallel to and opposite channel 48 when cover 44 is assembled with base 46. Channels 48 and 52 are preferably like sized and cooperate to form a passage around substrate 42 through which air is allowed to flow. Substrate 42 is, therefore, substantially suspended within the surrounding housing. Top cover 44 and base 46 are preferably aligned together by an arrangement of corresponding pins 54 and holes 56 as shown in FIG. 2 and they may be more securely joined or mounted together such as by screws 57 and corresponding holes 58 and 59 in the cover 44 and base 46, respectively.

Substrate 42 has a series of conductive paths which have been printed thereon by a photolithographic or similar process commonly known to those skilled in the art. The conductive paths are preferably gold but may be any other suitable highly conductive metal such as copper. These conductive paths form an input port 60, through which microwaves enter the filter, opposite an output port 62, through which microwaves within the passband leave the filter. Transmission line elements comprising transmission line 64, transmission path 70 and 74, and coupled lines 72 run between input port 60 and output port 62 and are preferably less than an eighth of a wavelength and, therefore, are electrically short and thus enable a small filter size.

Also formed on substrate 42 are a pair of printed bands 66, 68, each on an opposite edge of substrate 42 and running parallel to transmission line 64. When the cover 44 and base 46 are assembled as shown in FIG. 3, cover 44 contacts and is, therefore, conductively coupled to printed bands 66, 68. This creates a ground plane or short circuit from each of the bands 66, 68 to the housing. The conductive paths also include the pair of transmission paths 70 and 74, one for low side and one for high side transmission zero which enhances the out-of-band rejection. The pair of coupled lines 72 creates a bandpass-filter-type response. While the surface of substrate 42 having the conductive paths disposed thereon is shown in FIG. 2 as being disposed toward cover 44, substrate 42 could alternately be disposed in a reversed position with printed bands 66, 68 being conductively coupled to base 46.

An incoming microwave or millimeterwave signal in the passband enters input port 60 and is transmitted and coupled, from left to right, through transmission line 64 and coupled lines 72 and then leaves the filter through output port 62. Printed bands 70, 74 provide transmission zeros to reject out-of-band signals. This allows the filter to permit only the desired passband signal to go through while rejecting substantially all unwanted signal components.

Figure 4:
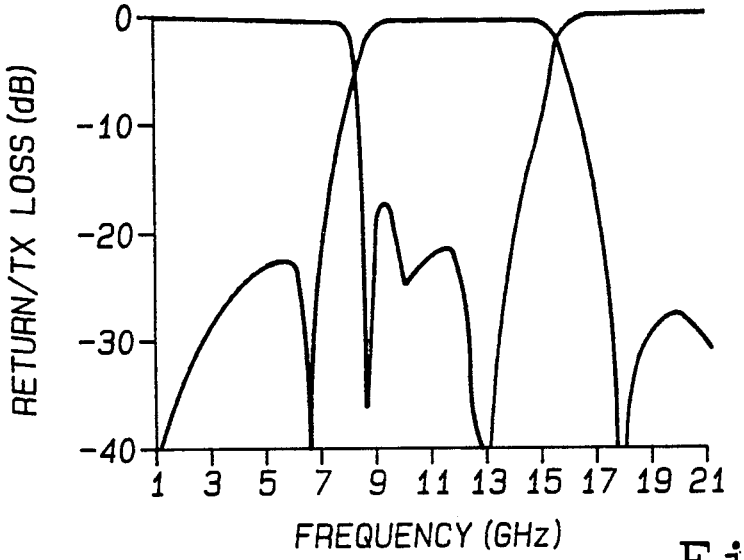
FIG. 4 is a graph of the in-band response of the filter of the present invention.
Figure 5:
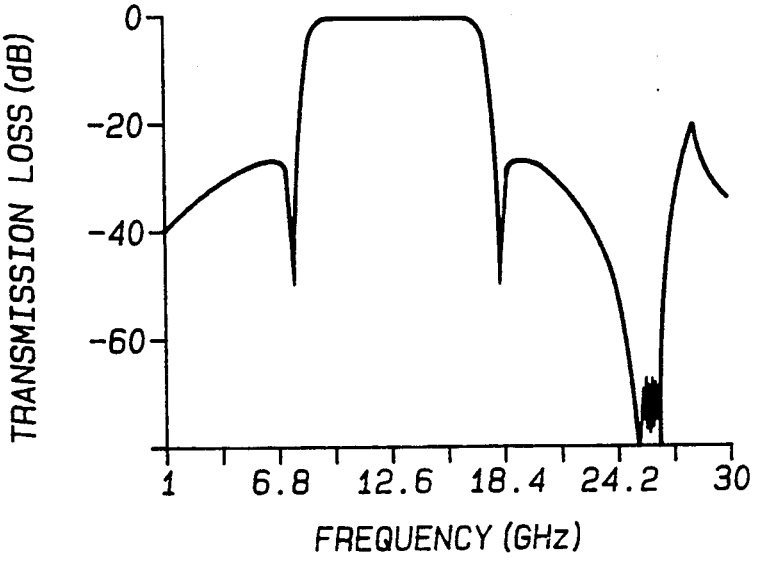
FIG. 5 is a graph of the filter's wideband response.

The signal characteristics of the filter 40 are shown in the graphs of FIGS. 4 and 5 wherein loss is plotted versus frequency. Midband transmission loss is less than 0.5 dB and return loss is greater than 15 dB. As shown in these figures, the filter exhibits desirable elliptical function response for high out-of-band rejection. The transmission loss (Tx) in the passband closely approaches zero making the filter very low loss. Also, two transmission zeroes are clearly demonstrated, one at low side and one at high side of the passband. The filter is well matched (better than 15 dB in return loss (Rt) as shown in FIG. 4) and requires no tuning screws.

The above described filter 40 has been shown to have characteristics superior to previous MMIC compatible bandpass filters. By moving the lower ground plane away from the GaAs substrate under the filter area, in effect suspending the substrate in a passage of air, low unloaded Q, common to all current MMIC compatible filters and by far the largest contributor to high passband insertion loss, is improved by an order of magnitude. Typical unloaded Q values of 200 have been achieved with this configuration, with a corresponding insertion loss improvement of between 8 and 10 to 1 as compared to conventional microstrip devices.

The elliptical function response achieves optimum filter size and minimizes insertion losses by utilizing finite transmission zeroes on each side of the passband. Electrically short filter elements minimize the effects of frequency dispersion on bandwidth and out-of-band attenuation. This enables a filter with a passband of up to an octave and wide spurious-free rejection bandwidths of up to 3:1. Furthermore, the single layer deposition on only one side of substrate 42 is easier and less expensive to manufacture than multilayer devices such as in conventional LE type of filters. Filter 40 is small in size and so as to be readily integrated with MMIC devices on a single chip and is adaptable to low cost, mass production applications.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

We claim:

1. A monolithic microwave/millimeter wave integrated circuit (MMIC) compatible bandpass filter comprising:

(a) a substantially rectangular conductive base, said base including a channel formed in a surface thereof and a pair of stepped shoulder regions each parallel to, adjacent and outboard said channel;

(b) a substantially rectangular conductive top including a channel formed in a surface thereof, said base and top cooperating to form a housing and said channels cooperating to form an opening through said housing;

(c) a dielectric substrate supported by said shoulder regions and substantially suspended within said opening; and (d) a plurality of conductive paths disposed on a single surface of said substrate, said paths forming an electrical bandpass filter and including a pair of conductive bands disposed along opposite edges of said substrate surface, said bands being conductively coupled to said conductive housing top to provide a ground plane for said filter, said paths further defining an input port, an output port and a transmission line conductively connecting said input and output ports, said paths also including at least one conductive transmission path which conductively connects said transmission line to at least one of said conductive bands for suppression of out-of-band signals.

2. The filter of claim 1 wherein said substrate is Gallium Arsenide.

3. The filter of claim 1 wherein said paths are formed of gold.

* * * * *